United States Patent [19]

Reeder

[11] 4,407,601

[45] Oct. 4, 1983

[54] CROSS-ARM BRACE

[75] Inventor: Gareld S. Reeder, Elk Grove Village, Ill.

[73] Assignee: Commonwealth Edison Co., Chicago, Ill.

[21] Appl. No.: 203,702

[22] Filed: Nov. 3, 1980

[51] Int. Cl.[3] ..... E04H 12/24

[52] U.S. Cl. ..... 403/25; 403/390; 403/400; 52/40

[58] Field of Search ..... 52/40, 697, 721; 403/388, 390, 400, 24, 25; 248/219.3, 219.4

[56] References Cited

U.S. PATENT DOCUMENTS

| | | | |
|---|---|---|---|
| 868,591 | 10/1907 | Yaxley | 52/697 |
| 1,802,995 | 4/1931 | Williams | 403/388 |
| 2,584,614 | 2/1952 | Rasmussen et al. | 403/400 |
| 2,704,586 | 3/1955 | Kennedy | 403/388 |
| 3,591,211 | 7/1971 | Richey | 403/395 |
| 3,819,290 | 6/1974 | Plotkin | 403/388 |

FOREIGN PATENT DOCUMENTS 462852 7/1965 Japan .

*Primary Examiner*—Andrew V. Kundrat

*Attorney, Agent, or Firm*—Hume, Clement, Brinks, Willian & Olds, Ltd.

[57] ABSTRACT

An improved cross-arm brace for supporting a cross-arm (24) on a utility support pole (23) is described. The brace has two support members (10) which lie along the support pole (23), one on each side of the support pole (23), and between the support pole (23) and the cross-arm (24). The support members (10) are connected to each other by one or more connecting members (11) which cross the pole (23) over that face of the pole (23) on which lies the cross-arm (24). Adjusting mechanisms (12, 14, 15, 16) associated with the connecting members (11) adjust to decrease the spacing between the support members (10) and thus to firmly wedge the support members (10) between the support pole (23) and the cross-arm (24). More than one cross-arm (24) on a support pole (23) can be supported by a single brace. The brace can be used in conjunction with a grid gain.

37 Claims, 9 Drawing Figures

FIG. 1
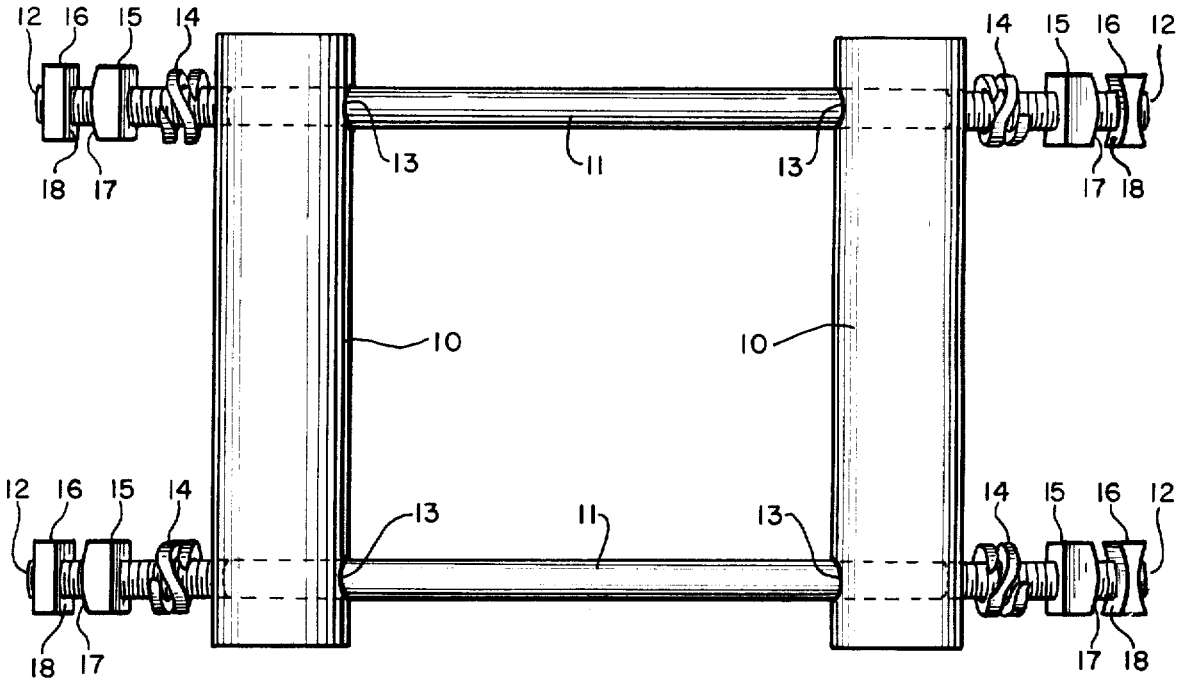
FIG. 2
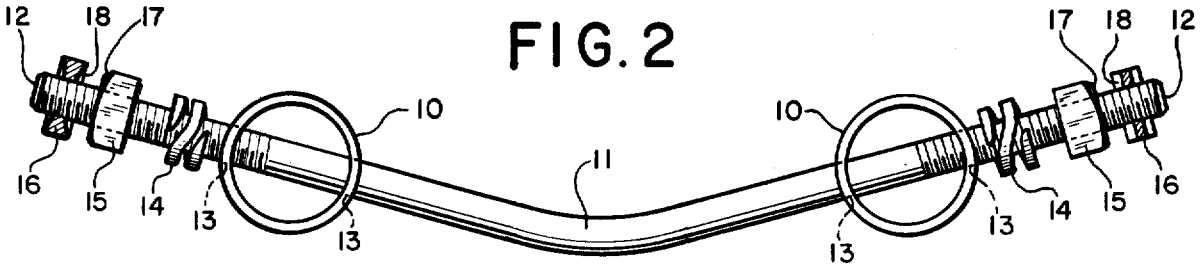
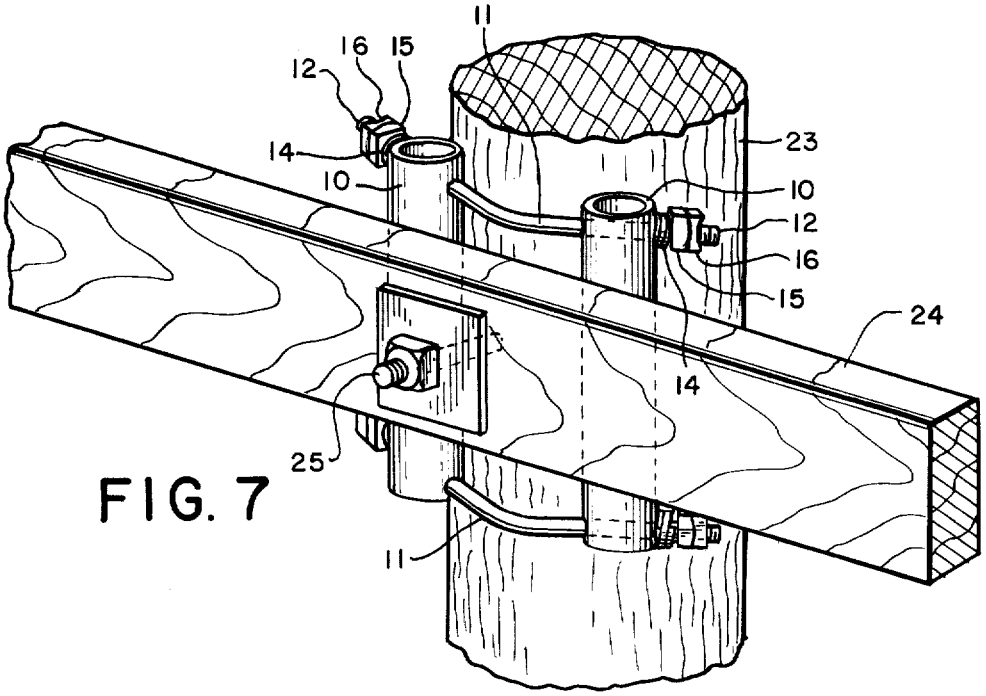
FIG. 7

FIG. 3
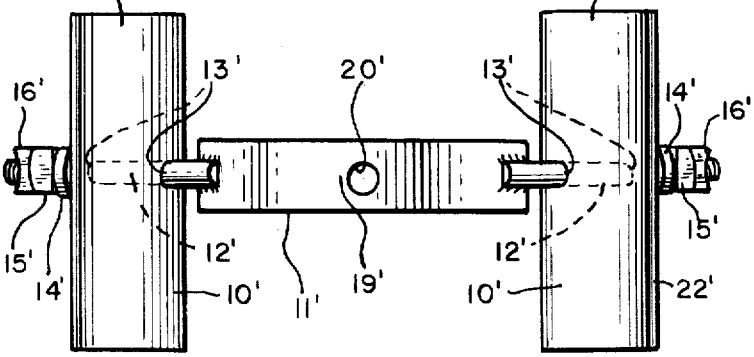
FIG. 8
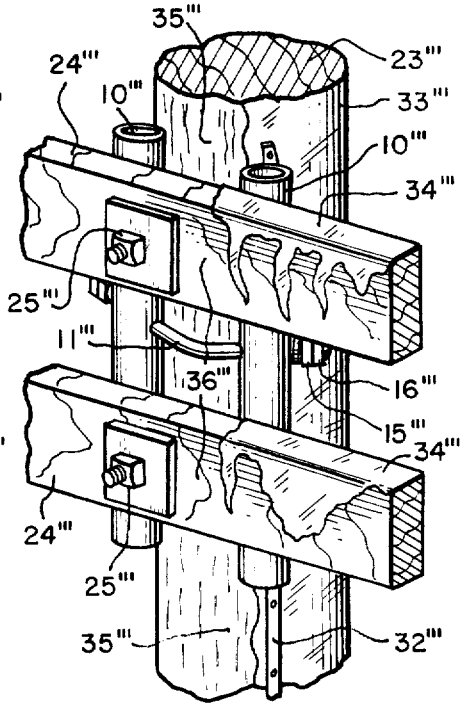
FIG. 4
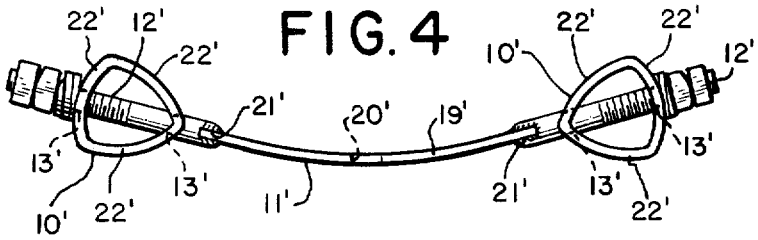
FIG. 5
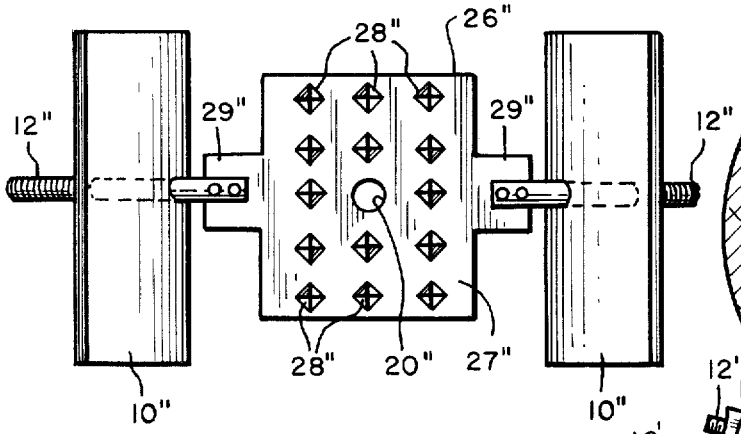
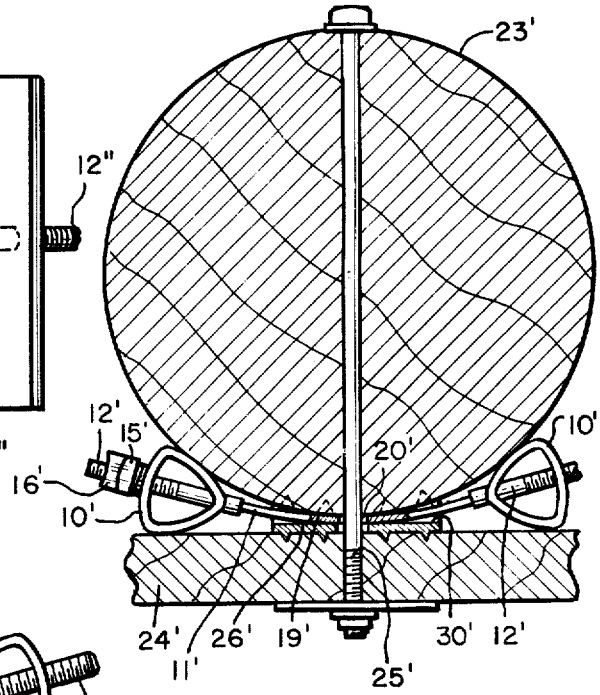
FIG. 9
FIG. 6
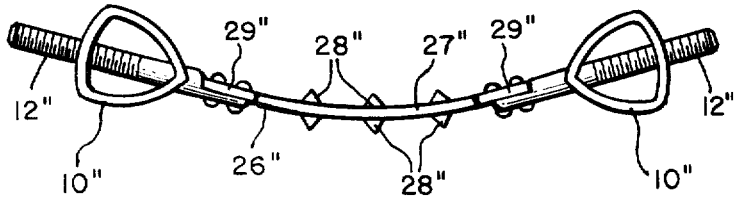

CROSS-ARM BRACE

BACKGROUND OF THE INVENTION

The invention relates to an improved method and apparatus for bracing a cross-arm on a support pole, in particular on a utility cable-bearing support pole.

In above-ground public utility transmission systems, such as telephone or electric power transmission systems for example, electrical currents are generally transmitted by means of cables suspended between utility poles. The poles are often of a circular cross-section and each includes one or more cross-arms to which cables are mounted by means of insulators. A cross-arm can be attached to a pole by various means, such as by a clamp, a gain fixture, or, most often, by a bolt running diametrically through both the cross-arm and the pole.

Under circumstances such as high winds after icing precipitation, the suspended cables can begin to oscillate. This oscillation puts a strain on the cross-arms and tends to rotate them about an axis formed by the support pole. This back-and-forth rotating motion in turn fatigues the bolts used to connect the cross-arms to the poles, causing the cross-arm to break away from the support pole. This in turn generally causes the cables to contact the support poles, thereby creating danger of fires started by sparks, interruption of service, and the burdensome cost, in terms of both money and time, of repairing or replacing the cables, cross-arms and, often, the poles.

The prior art has attempted to solve this problem by the use of grid gains. A grid gain is a metal plate, generally about the size of the cross-section of the cross-arm, with one of its faces contoured to fit the surface of the pole and the other face contoured to receive the cross-arm. The gain is permanently inserted between the cross-arm and a pole before the two are attached together. Thus the gain essentially provides a surface area for the cross-arm to contact, as opposed to only a line or a point area of contact when the cross-arm is mounted directly to the pole, and thereby the gain offers some resistance to the rotation of the cross-arm.

While useful, the gain has not completely solved the problem. First, the gain can be expensive to manufacture, depending upon its complexity. Second, if the gain were made large enough to solve the rotation problem, a different size of gain would be required for each range of shapes and sizes of poles and cross-arms, since the gain must be contoured to fit their surfaces. Third, in retrofit installations, the cross-arm must be dismounted from the pole so that the gain may be inserted between them, which results in high costs in terms of effort and money and often also results in interruption of service during retrofitting. Fourth, the gain, in its currently available sizes, has not been totally effective in preventing the rotation of the cross-arm because the gain provides a support surface area for the cross-arm only in the immediate area surrounding the axis of rotation, where the support is least effective.

Another approach known to the industry to reduce cross-arm rotation has been a back brace, generally consisting of two rods, attached to and extending between the back side of the pole and some point along the length of the cross-arm, with one rod extending to each end of the cross-arm. But this approach suffers from certain disadvantages as well. When a back brace is retrofitted, the cross-arm may have to be dismounted and re-installed and the cross-arm must be field drilled in two places for the purpose of attaching the brace thereto. Consequently, this approach has been found to be both difficult and costly to implement.

Yet another problem plaguing the utility industry has been the fires on poles started when precipitation has wetted the insulators, cross-arms, and poles, thus substantially decreasing their surface resistivity and causing them to act as conductors for power line leakage current. Under certain conditions of precipitation, the areas around the bolt connecting the pole and cross-arm and the surface between the pole and cross-arm remain dry, leaving a high resistance gap between the wetted conductive surfaces of the pole and cross-arm, which gap effectively acts as an electric heater with the flow of the electric current. Resulting heating and arcing can ignite fires which can destroy the entire utility pole.

SUMMARY OF THE INVENTION

The present invention is directed to an improved method and apparatus for bracing a cross-arm on a support pole which avoids these and other disadvantages of the prior art.

According to a first aspect of this invention, a brace is provided which is readily installed on a preexisting pole and cross-arm without disassembly or drilling of the cross-arm of the pole. This brace includes two elongated support members having convex surfaces along their length. The support members are connected to each other by at least one adjustable connecting member, preferably a curved bolt or a flexible strap.

On a pole which has at least one cross-arm attached to its face, an embodiment of the invention which utilizes two connecting members is preferably utilized with each cross-arm. The two support members are placed lengthwise along the pole, adjacent to the cross-arm, one support member on each side of the pole. Thus the support members preferably lie along the surface of the pole, each support member in its respective wedge-shaped space created by the pole and cross-arm at their crossing. The two support members are connected to each other across the face of the pole on which the cross-arm contacts the pole by two connecting members, with one connecting member lying on each side of the cross-arm.

On a pole which has attached to it at least two adjacent cross-arms which lie in the same plane, a second embodiment of this invention may be utilized to support two or more of the co-planar cross-arms. The two support members of this brace are long enough to extend along the pole into the wedge-shaped spaces under two or more of the co-planar cross-arms. The support members are connected by at least one connecting member. The at least one connecting member is positioned such that a one connecting member lies across the face of the pole between adjacent cross-arms.

Both of the above-mentioned embodiments of the invention include an adjusting means associated with each connecting member. After the support members have been coupled together by the connecting member, the adjusting means is then adjusted to draw the support members closer together and thus to wedge them into the spaces between the pole and each cross-arm on each side of the pole.

One important advantage provided by this invention is that the wedged-in support members provide two points of support, spaced from the point of contact of the pole and the cross-arm, against which the cross-arm can lean and thus resist rotation about the pole. The support members substantially eliminate rotation of the cross-arm as well as the problems associated with cross-arm rotation.

A second advantage of these embodiments of this invention is that the support brace can be easily retrofitted to an existing installation. It does not require the mounting or dismounting of the cross-arm from the pole, it requires no modification of the pole or the cross-arm, and it requires no field drilling.

A third advantage of the invention is that the support brace is adjustable for a wide range of sizes and shapes of the cross-arm and pole. Thus, the support brace need be manufactured in only a small number of sizes, and tooling, inventory, storage, and documentation costs are thereby reduced.

Other advantages attendant to the brace of this invention are the simplicity of its construction and manufacture, and its ease of installation. In addition, the brace of this invention does not hinder adjustment of the cross-arm away from perpendicular to the pole, it can provide electrical contact between the surfaces of the cross-arm and the pole, and it can often be used in conjunction with a preexisting bracing means, such as a grid gain or a back brace.

According to a second aspect of this invention, a brace is provided which is intended for new installations. This brace also includes two elongated support members having convex surfaces along their length, and the support members are connected to each other by an adjustable connecting member. But this connecting member is designed to be positioned inbetween the cross-arm and the pole. This brace can be used either with or without a grid gain.

One preferred embodiment of the connecting member includes a flat flexible adjustable strap. In use it lies inbetween the cross-arm and the pole. In an alternative configuration the strap is used in conjunction with a grid gain and lies in a channel formed in a face of the grid gain while the grid gain lies interposed between the cross-arm and the pole.

Another preferred embodiment of the connecting member is a grid gain having a flexible adjustable strap attached thereto and extending to the sides. For use on installations which utilize a single mounting bolt driven diametrically through the cross-arm and the pole to attach the cross-arm to the pole, these embodiments of the connecting member have a hole formed at their midpoint to allow the mounting bolt to pass therethrough.

Before a cross-arm is mounted to the pole, a connecting member of this aspect of the invention, with or without a grid gain, is positioned across the face of the pole directly under each cross-arm, such that upon the mounting of each cross-arm the connecting member will lie between the pole and the cross-arm and the ends of the strap will extend to the sides of the pole. The cross-arm is then mounted over the connecting member (and grid gain, if one is used) to the pole. The two support members of the brace are then placed lengthwise along the pole, adjacent to the cross-arm, one support member on each side of the pole. Thus the support members preferably lie along the surface of the pole, each support member in its respective wedge-shaped space created by the pole and cross-arm at their crossing. The two support members are connected to the ends of the connecting member. The connection having been made, an adjusting means associated with the connecting member is then adjusted to draw the support members closer together and thus to wedge them into the spaces between the pole and the cross-arm on each side of the pole.

This second aspect of the invention provides essentially the same advantages as the first aspect, discussed above, with the exception of ease of retrofitability. It has the additional advantages that it utilizes a single connecting means, which represents a saving in materials with a resulting saving in costs, and a saving in installation time by virtue of fewer connecting means having to be connected and adjusted. When used in conjunction with a separate grid gain or when used with a connecting member that incorporates a grid gain, the invention has the further advantage that it provides the cross-arm with the dual support of both the brace and the grid gain. The preferred embodiment of the invention which incorporates the grid gain into the connecting member also reduces production costs, the number of parts, and simplifies installation.

The invention itself, together with further objects and attendant advantages, will be best understood by reference to the following description taken in connection with the accompanying drawings.

BRIEF DESCRIPTION OF THE DRAWINGS

FIG. 1 is a front view of a first preferred embodiment of the improved cross-arm brace of this invention.

FIG. 2 is a top view of the brace of FIG. 1.

FIG. 3 is a front view of a second preferred embodiment of the cross-arm brace of this invention.

FIG. 4 is a top view of the brace of FIG. 3.

FIG. 5 is a frontal perspective view of a third embodiment of the cross-arm brace of this invention.

FIG. 6 is a top view of the brace of FIG. 5.

FIG. 7 is a perspective view of the first preferred embodiment of this invention as it appears during use on a utility pole having a cross-arm.

FIG. 8 is a perspective view of a fourth preferred embodiment of this invention as it appears during use on a utility pole having two closely spaced co-planar cross-arms.

FIG. 9 is a sectional view of the second embodiment of this invention as it appears in use on a utility pole having a cross-arm and a grid gain.

DETAILED DESCRIPTION OF THE PREFERRED EMBODIMENTS

Referring now to the drawings, FIGS. 1 and 2 show a first preferred embodiment dof the improved cross-arm brace of the present invention.

This first preferred embodiment includes support members 10, each of which is a section of hollow cylinder, such as a length of pipe. The support members 10 can be made of any weather proof, substantially rigid and sturdy material, but are preferably formed of metal. The support members 10 can be varied in size according to the intended application. For utility pole purposes, where pole diameter generally ranges from about 9.5 to about 17 inches (about 24 to 43 cm), the diameter of the support members is preferably about 1.5 to about 2 inches (about 4 to 5 cm), but more preferably about 2 inches (about 5 cm). The wall thickness of the support members of this preferred embodiment is about ⅛ inch (about 0.3 cm), and the support members' length is preferably in the range of about 6 to about 12 inches (about 15 to 30 cm).

The support members 10 lie parallel to each other and are connected toward their ends by two adjustable connecting members 11 which are oriented generally transverse to the support members. Preferably, the connecting members 11 are symmetrically spaced along the length of each support member 10 from the support member's center point. In this preferred embodiment the connecting members 11 are metal rods which are bent or curved substantially at their mid portion. For utility pole application, the rods are preferably about ½ inch (about 1.3 cm) thick and about 17 inches (about 43 cm) long. The angle of the bent rods can vary from about 25° to about 45°, but is preferably 30°. The radius of curvature of the bent portion of the rod can vary from about 4 to 8 inches (about 10 to 20 cm), but is preferably 6 inches (about 15 cm).

The end sections 12 of the connecting members 11 pass diametrically and perpendicularly through the support members 10, via pairs of diametrically opposed holes 13 which have been drilled or stamped in the side walls of the support members 10.

The connecting members 11 have their end sections 12 threaded. Mounted onto each threaded end section 12 is a lockwasher 14, a nut 15, and a locknut 16. The lockwashers 14 are doubly-coiled in order to provide not only a locking action, but also a springing action that keeps the support members 10 firmly seated between a pole and cross-arm. Each lockwasher 14 is positioned between the respective support member 10 and nut 15.

The function of the nuts 15 is twofold: to provide the force necessary to wedge the support members 10 inbetween a pole and a cross-arm and also to adjust the effective length of the connecting members 11 for the particular pole size on which the brace is being used. The faces 17 of nuts 15 which face the ends of the threaded end portions 12 are preferably flat with a convex surface at each outer corner of the nut 15. The faces 18 of the locknuts 16 which face the nut faces 17 have an inward, concave, curve along a single axis. After the nuts 15 are tightened to their final position against the lockwashers 14, locknuts 16 are tightened and their curved faces 18 forced against the flat faces 17. Locknuts 16 are thereby deformed so that curved faces 17 become flat and the threads of locknuts 16 pinch tightly against the threaded end sections 12, thus providing additional resistance to the nuts 15 becoming loose during use.

FIGS. 3 and 4 show a second preferred embodiment of the cross-arm brace of the present invention. This embodiment is primarily useful for new installations as oppsed to retrofit use. As FIG. 3 shows, the two support members 10' of this second embodiment are connected by a single connecting member 11'. The connecting member 11' is centrally located along the length of the support members 10'. The end sections 12' of the connecting member 11' pass diametrically and perpendicularly through the support members 10' via pairs of opposed holes 13', which have been drilled or stamped in the side walls of the support members 10'.

The end sections 12' of the connecting member 11' are lengths of threaded rods. For utility pole application, they are preferably about ½ inch (about 1.3 cm) in diameter and are about 6 inches (about 15 cm) long. They are connected to a flexible, preferably metal, strip 19' which forms the central body section of the connecting member 11'. The strip 19' has a centrally-placed hole 20', whose function is to receive the bolt which attaches a cross-arm to a pole. For utility pole application, the strip 19' is preferably a steel plate about 6 inches (about 15 cm) long, about 1 ½ inches (about 4 cm) wide, and about ½ inch (about 0.3 cm) thick. The hole 20' is preferably about 13/16 inches (about 2.1 cm) in diameter. At the junctures of the end sections 12' and the strip 19' the end sections 12' have slots 21' extending along their diameters across their faces, into which slots the ends of the strip 19' are received and attached by any suitable means, such as by welding. Each threaded end section 12' has mounted thereon a lockwasher 14', nut 15', and locknut 16' as in FIGS. 1 and 2.

The support members 10' need not be of a circular cross-section. They may, for example, be of elliptical cross-section, or a multi-sided cylinder having outwardly curved sides. The outward curvature of the sides helps to assure effective wedging of the support member for a wide range of pole diameters. FIG. 4 shows one embodiment of this alternative structure, in which the support members 10' each have three surfaces 22' convex along a single axis running along the length of the support members.

FIGS. 5 and 6 show a third embodiment of the cross-arm brace of the present invention. This embodiment is similar to the embodiment of FIGS. 3 and 4 except that the flexible strip 19' has been replaced with a grid gain 26''. For utility pole applications, the grid gain 26'' is preferably a plate 27'' of thick sheet metal about 4 by 4 inches (about 10 cm by 10 cm) in size, with teeth 28'' formed in both of its faces. The teeth 28'' can be formed by punching, for example. The purpose of the teeth is to bite into the surface of the pole and cross-arm and thus to provide a rigid connection between them. The plate 27'' has two ears 29'' which extend to the side. To these ears 29'' attach threaded end sections 12''. The attachment can be accomplished by riveting, for example. The plate 27'' has a centrally-placed hole 20'', whose function again is to receive the bolt which attaches a cross-arm to a pole.

FIG. 7 shows an installation utilizing the first preferred embodiment of the present invention shown in FIGS. 1 and 2. Shown is a utility pole 23 having a cross-arm 24 attached thereto by a bolt 25. Wedged between the cross-arm 24 and the pole 23 is the cross-arm support brace of FIGS. 1 and 2.

To install the cross-arm brace as shown in FIG. 7, the cross-arm 24 is first securely attached to the pole 23 by the bolt 25. Both connecting members 11 are then attached to one support member 10 by passing one threaded end 12 of each connecting member 11 through diametrically opposed holes 13 of the support member 10, and by loosely mounting a lockwasher 14, nut 15, and locknut 16 over that threaded end 12 of each connecting member 11. The support member 10 which has the connecting members 11 attached thereto in then placed in one of the two wedge-shaped spaces between the cross-arm 24 and the pole 23, and the connecting members 11 are positioned to lie across the face of the pole 23 to which the cross-arm 24 is attached, one connecting member 11 on each side of the cross-arm 24. The second support member 10 is now placed in the other wedge-shaped space between the cross-arm 24 and the pole 23 and is loosely connected to the connecting members 11 in the same manner as the first support member 10 was connected. The support members 10 are now positioned to lie parallel to the pole 23 in contact with both the pole 23 and the cross-arm 24, and the connecting members 11 are positioned to lie perpendicular to the face of the pole 23 and equally spaced from the cross-arm 24. With the brace thus positioned, the four nuts 15 are tightened to wedge the support members 10 snugly between the cross-arm 24 and pole 23. When the desired degree of snugness is achieved, each of the four locknuts 16 is tightened over its respective nut 15 to lock it in place and to keep it from loosening. Thus, the cross-arm is braced against rotation, without need to disassemble the cross-arm from the pole to accomplish the bracing.

FIG. 8 shows another installation utilizing yet another embodiment of the present invention. In FIG. 8 the utility pole 23''' carries two closely spaced co-planar cross-arms 24''' attached to the pole 23''' by bolts 25'''. Both cross-arms 24''' are braced by a single support brace which includes two support members 10''' connected by a single connecting member 11''' positioned substantially centrally within the spacing between the two cross-arms 24'''.

To install the cross-arm brace as shown in FIG. 8, essentially the same procedure is followed as described for FIG. 1. With the cross-arms 24''' attached to the pole 23''', first the connecting member 11''' is loosely mounted to one support member 10'''. Then that support member 10''' is placed between the cross-arms 24''' and pole 23''', the connecting member 11''' is placed across the face of the pole 23''' between the two cross-arms 24''', and the second support member 10''' is placed between the cross-arms 24''' and pole 23''' and loosely mounted to the connecting member 11'''. The support members 10''' are now properly positioned in their wedge-shaped spaces to each contact both cross-arms 24''', the connecting member 11''' is positioned centrally between the cross-arms 24''' and perpendicular to the face of the pole 23''', and the nuts 15''' and locknuts 16''' are tightened to wedge and secure the support members 10''' between the cross-arms 24''' and pole 23'''.

Also shown in FIG. 8 is the grounding function which the cross-arm brace of this invention can provide. Precipitation often causes the exposed (shaded) surface areas 34''' and 33''' of the cross-arms 24''' and pole 23''', respectively, to be wetted, while the surface areas 36''' and 35''' of the cross-arms 34''' and pole 23''', respectively, which are shaded by the pole 23''', remain dry. As the support members 10''' of the brace lie at least partially out of the shaded region, they provide electrical contact between the wetted areas 34''' of the cross-arms 24''' and the wetted area 33''' of the pole 23'''. As the wetted areas are conductive, a continuous conductive path is provided for leakage current, with no high-resistance gap between the cross-arms 24''' and 23''' to cause heating and arcing and resultant fires. To provide even a better conductive path, a strip 32''' of conducting material, such as a wire, is attached to the face of the pole 23'''. The strip 32''' contacts at least one support member 10''' of the brace and runs the length of the pole 23''' and into the ground.

FIG. 9 shows yet another installation utilizing the present invention. It shows the cross-arm brace of the embodiment of FIGS. 3 and 4 in use with a grid gain. Aside from the grid gain 26' being separate from the connecting member 11', this installation is similar to an installation utilizing the cross-arm brace of the embodiment of FIGS. 5 and 6.

FIG. 9 shows utility pole 23' having a cross-arm 24' attached thereto. Interposed between the cross-arm 24' and pole 23' is the grid gain 26'. The faces of the grid gain 26' are contoured to fit the surface of the cross-arm and the pole. Teeth formed in the faces of the grid gain 26' engage the surface of the cross-arm 24' and the pole 23'. Also formed across the center of the pole-contacting face of the grid gain 26' is a channel 30' which is transverse to the face of the pole 23'. Through the channel 30' passes the flexible strip 19' of the connecting member 11'. The bolt 25' passes through the cross-arm 24', a hole in the center of the grid gain 26', hole 20' of the strip 19', and the pole 23', thus tying the cross-arm 24' to the pole 23'.

To install the cross-arm brace as shown in FIG. 9, first the bolt 25' is driven diametrically through the pole 23'. Then the connecting member 11' and the grid gain 26' are mounted on the bolt 25'. The bolt 25' is then driven diametrically through the cross-arm 24' and secured there by a nut, thus mounting the cross-arm 24', grid gain 26', and connecting member 11' onto the pole. Next, the two support members 10' are placed one in each wedge-shaped space formed by the cross-arm 24' and the pole 23' and are loosely attached to the connecting member 11', as described for FIG. 7. The support members 10' are then properly aligned with respect to the pole 23' and cross-arm 24', as is the connecting member 11', and then the support members 10' are wedged and secured between the pole 23' and cross-arm 24' by tightening of the nuts 15' and locknuts 16'.

Of course, it should be understood that various changes and modifications to the preferred embodiments described herein will be apparent to those skilled in the art. For example, the dimensions of the various components may be changed, or the connecting members may be made adjustable by other means than those described. Such changes and modifications can be made without departing from the spirit and the scope of the present invention, and without diminishing its attendant advantages. It is therefore intended that such changes and modifications be covered by the following claims.

I claim:

1. An improved utility pole cross-arm brace comprising:

first and second support members, each support member having outwardly-curved outer surfaces along its length, both support members positioned substantially parallel to each other;

at least one connecting member separably connecting the first and second support member, the at least one connecting member sized and shaped to lie across a face of a utility pole of the type comprising at least one cross-arm and a fastener which extends through the cross-arm and into the pole to securely mount the cross-arm to the pole, said utility pole and cross-arm being adapted to support utility cables; and adjusting means, associated with the at least one connecting member, for varying the transverse spacing between the first and second support members, to wedge the first and second support members between the utility pole and the at least one cross-arm mounted to the pole such that the support members brace the at least one cross-arm against rotation in a plane transverse to the utility pole.

2. An improved utility pole cross-arm brace comprising:

first and second elongated, hollow support members of substantially constant cross-section, each support member having its outer surface comprised of at least one surface convex along an axis running parallel to and along the length of the support member, the support membrs being positioned substantially parallel to each other and lying to the side of each other; and at least one elongated connecting member lying substantially perpendicular to the first and second support members and separably connecting the first support member with the second support member, the at least one connecting member adapted to lie across a face of a utility pole, each-connecting member being adjustable to vary the transverse spacing between the first and second support members, to wedge the first and second support members between the utility pole and at least one cross-arm mounted to the pole to brace the at least one cross-arm against rotation.

3. An improved cross-arm bearing utility pole comprising:

a utility support pole;

at least one cross-arm mounted to the support pole, said cross-arm comprising means for supporting a plurality of utility cables;

at least one pair of support members, each support member having outwardly-curved outer surfaces along its length, the support members of each pair of support members positioned lengthwise along first and second sides of the support pole and wedged between the support pole and the at least one cross-arm;

at least one connecting member connecting the two support members of each pair of support members, the at least one connecting member lying across the side of the support pole to which is mounted the at least one cross-arm; and adjusting means for shortening the at least one connecting member to wedge the pair of support members between the support pole and the at least one cross-arm to brace the at least one cross-arm against rotation.

4. The apparatus of claim 1 or 2 or 3 wherein each support member includes two openings for each connecting member, each opening having substantially the size and shape of the cross-section of the associated connecting member, the openings formed in the walls of the support member and diametrically opposed to each other and communicating with each other.

5. The apparatus of claims 1 or 3 wherein each support member is hollow.

6. The apparatus of claim 1 or 2 or 3 wherein each support member is cylindrical.

7. The apparatus of claim 1 or 2 or 3 wherein each support member has its outer surface comprised of three similar convex surfaces.

8. The apparatus of claim 1 or 2 or 3 wherein the number of connecting members is one.

9. The apparatus of claim 1 or 2 or 3 wherein the number of connecting members is two.

10. The apparatus of claim 1 or 2 or 3 wherein each connecting member is adjustable at at least one end thereof.

11. The apparatus of claim 1 or 2 or 3 wherein each connecting member includes a rod curved along its mid-section and having its end sections threaded.

12. The apparatus of claim 11 wherein each threaded rod section has mounted thereon a double-coiled lockwasher, a nut, and a locknut, the nut having a surface which adjoins the locknut, the surface including a substantially flat central portion and a convex outer portion, the locknut having a face which adjoins the nut surface, the face being concave along a single axis.

13. The apparatus of claim 2 wherein each connecting member includes a flexible strip.

14. The apparatus of claim 13 wherein each connecting member further includes a length of threaded rod attached to at least one end of the strip.

15. The apparatus of claim 14 wherein each threaded rod section has mounted thereon a double-coiled lockwasher, a nut, and a locknut, the nut having a surface which adjoins the locknut, the surface including a substantially flat central portion and a convex outer portion, the locknut having a face which adjoins the nut surface, the face being concave along a single axis.

16. The apparatus of claim 1 or 2 or 3 wherein the connections of the connecting members to each support member are symmetrically located with respect to the center point of the support member.

17. An improved utility pole cross-arm brace comprising:

first and second support members, each support member having outwardly-curved outer surfaces along its length, both support members positioned substantially parallel to each other;

a connecting member connecting the first and second support member; the connecting member dimensioned and shaped to mount inbetween a utility pole and a cross-arm which supports a plurality of utility cables, wherein the cross-arm is mounted to the utility pole by a fastener which extends into the cross-arm and the utility pole; and adjusting means, associated with the connecting member, for varying the transverse spacing between the first and second support members, to wedge the first and second support members between the utility pole and the cross-arm mounted to the pole to brace the cross-arm against rotation about the fastener in a plane transverse to the utility pole.

18. An improved cross-arm bearing utility pole comprising:

a utilityf support pole;

a cross-arm mounted to the support pole, said cross-arm comprising means for supporting a plurality of utility cables;

a pair of support members, each support member having outwardly-curved outer surfaces along its length, the pair of support members positioned length-wise along first and second sides of the support pole and wedged between the support pole and the cross-arm;

a connecting member connecting the pair of support members, the connecting member lying in between the pole and the cross-arm and extending to first and second sides of the pole; and adjusting means for shortening the connecting member to wedge the pair of support members between the support pole and the cross-arm to brace the cross-arm against rotation.

19. The apparatus of claim 17 or 18 wherein the connecting member includes a flat flexible strip having a hole therethrough positioned and sized to receive a bolt for connecting the cross-arm to the pole.

20. The apparatus of claim 17 or 18 wherein the connecting member includes a grid gain centrally located in the connecting member.

21. The apparatus of claim 20 wherein the grid gain is formed of sheet metal and has teeth formed in its surfaces by punching through the sheet metal.

22. The apparatus of claim 20 wherein the grid gain has a hole therethrough positioned and sized to receive a bolt for connecting the cross-arm to the pole.

23. The apparatus of claim 18 wherein the connecting member includes a flat flexible strip and the apparatus further including a grid gain lying in between the pole and the cross-arm, the grid gain having a channel formed in its side which faces the pole, the channel sized, shaped and positioned to receive the flat flexible strip.

24. An improved method of bracing against rotation at least one cross-arm mounted to a support pole, the method comprising the steps of:

placing first and second support members lengthwise along a first and second side of a support pole, respectively, between the support pole and at least one cross-arm;

connecting the first support member with the second support member by means of at least one connecting member placed across a surface of the pole on which surface the at least one cross-arm is mounted; and adjusting the effective length of the at least one connecting member to draw the support members closer together, thereby wedging the support members between the support pole and the at least one cross-arm to brace the at least one cross-arm against rotation, without disassembling the at least one cross-arm from the pole.

25. An improved method of bracing against rotation at least one cross-arm mounted to a support pole, the method comprising the steps of:

placing first and second support members lengthwise along a first and second side of a support pole, respectively, between the support pole and at least one cross-arm, such that the support members lie substantially parallel to and in contact with the support pole and substantially transverse to and in contact with the at least one cross-arm;

connecting the first support member with the second support member by means of at least one connecting member placed substantially perpendicularly across the length of a surface of the pole to which surface the at least one cross-arm is mounted; and adjusting the effective length of the at least one connecting member to shorten it in order to draw the support members more snugly against the pole and the at least one cross-arm, thereby wedging the support members between the support pole and the at least one cross-arm to brace the at least one cross-arm against rotation, without disassembling the at least one cross-arm from the pole.

26. An improved method of bracing against rotation a cross-arm on a support pole, the method comprising the steps of:

placing a connecting member having a flat central portion across the length of a side of a support pole;

laying a cross-arm over the connecting member;

mounting the cross-arm to the support pole;

positioning first and second support members lengthwise along a first and second side of the support pole, respectively, between the support pole and the cross-arm;

connecting the first support member with the second support member by means of the connecting member; and adjusting the effective length of the connecting member to draw the support members closer together, thereby wedging the support members between the support pole and the cross-arm to brace the cross-arm against rotation.

27. An improved method of bracing against rotation a cross-arm on a support pole, the method comprising the steps of:

placing a connecting member including a flat central portion having a hole therethrough positioned and sized to receive a bolt for connecting a cross-arm to a pole across the length of a side of the support pole;

laying the cross-arm over the connecting member;

fastening the cross-arm to the support pole by means of a fastener which passes through the connecting member;

positioning first and second support members lengthwise along the first and second side of the support pole, respectively, between the support pole and the cross-arm, such that the support members lie substantially parallel to and in contact with the support pole and substantially transverse to and in contact with the cross-arm;

connecting the first support member with the second support member by means of the connecting member;

adjusting the effective length of the connecting member to shorten it in order to draw the support members more snugly against the pole and the cross-arm, thereby wedging the support members between the support pole and the cross-arm to brace the cross-arm against rotation.

28. The method of claims 26 or 27 further comprising, as a second step, the step of:

placing a grid gain on the support pole over the flat portion of the connecting member, the grid gain having a channel formed in its side which faces the pole, the channel sized, shaped, and positioned to receive the flat portion of the connecting member.

29. An improved cross-arm bearing utility pole comprising:

first and second support members, each support member having outwardly-curved outer surfaces along its length, both support members positioned substantially parallel to each other;

at least one connecting member separably connecting the first and second support member, the at least one connecting member adapted to lie across the face of a utility pole, said connecting member comprising a flexible strip; and adjusting means, associated with the at least one connecting member, for varying the transverse spacing between the first and second support members, to wedge the first and second support members between the utility pole and at least one cross-arm mounted to the pole to brace the at least one cross-arm against rotation.

30. An improved cross-arm bearing utility pole comprising:

a support pole;

at least one cross-arm mounted to the support pole;

at least one pair of support members, each support member having outwardly-curved outer surfaces along its length, the support members of each pair of support members positioned lengthwise along first and second sides of the support pole and wedged between the support pole and the at least one cross-arm;

at least one connecting member connecting the two support members of each pair of support members, the at least one connecting member lying across the side of the support pole to which is mounted the at least one cross-arm, said connecting member comprising a flexible strip; and adjusting means for shortening the at least one connecting member to wedge the pair of support members between the support pole and the at least one cross-arm to brace the at least one cross-arm against rotation.

31. The apparatus of claim 29 or 30 wherein each connecting member further comprises a length of threaded rod attached to at least one end of the strip.

32. The apparatus of claim 31 wherein each threaded rod section has mounted thereon a double-coiled lockwasher, a nut, and a locknut, the nut having a surface which adjoins the locknut, the surface including a substantially flat central portion and a convex outer portion, the locknut having a face which adjoins the nut surface, the face being concave along a single axis.

33. The apparatus of claim 29 or 30 wherein the connecting member lies in between the pole and the cross-arm, and wherein the flexible strip of the connecting member is flat and defines a hole therethrough positioned and sized to receive a bolt for connecting the cross-arm to the pole.

34. The apparatus of claim 29 or 30 wherein the connecting member lies in between the pole and the cross-arm and wherein the connecting member comprises a grid gain centrally located in the connecting member.

35. The apparatus of claim 34 wherein the grid gain is formed of sheet metal and has teeth formed in its surfaces by punching through the sheet metal.

36. The apparatus of claim 34 wherein the grid gain has a hole therethrough positioned and sized to receive a bolt for connecting the cross-arm to the pole.

37. The apparatus of claim 30 wherein the connecting member lies in between the pole and cross-arm and wherein the connecting member further comprises a grid gain lying in between the pole and the cross-arm, the grid gain having a channel formed in its side which faces the pole, the channel sized, shaped and positioned to receive the flat flexible strip.

* * * * *